US005618781A

United States Patent [19]

Magid et al.

[11] Patent Number: 5,618,781

[45] Date of Patent: Apr. 8, 1997

[54] AZEOTROPE-LIKE COMPOSITIONS OF DICHLOROPENTAFLUOROPROPANE AND METHYLPENTANE

[75] Inventors: Hillel Magid, Buffalo; David P. Wilson, E. Amherst; Dennis M. Lavery, Springville; Richard M. Hollister; Richard E. Eibeck, Orchard Park; Michael Vanderpuy, Cheektowage, all of N.Y.

[73] Assignee: AlliedSignal Inc., Morris County, N.J.

[21] Appl. No.: 834,022

[22] Filed: Feb. 11, 1992

Related U.S. Application Data

[63] Continuation of Ser. No. 526,874, May 22, 1990, Pat. No. 5,118,438, which is a continuation-in-part of Ser. No. 417, 951, Oct. 6, 1989, abandoned, and a continuation-in-part of Ser. No. 418,050, Oct. 6, 1989, abandoned, and a continuation-in-part of Ser. No. 454,789, Dec. 21, 1989, abandoned.

[51] Int. Cl.[6] ..... C11D 7/30; C11D 7/50; C23G 5/028

[52] U.S. Cl. ..... 510/177; 510/175; 510/256; 510/273; 510/408; 510/285; 252/364; 134/12; 134/31; 134/38; 134/39; 134/40

[58] Field of Search ..... 252/162, 172, 252/364, DIG. 9; 134/12, 31, 38, 39, 40; 510/175, 177, 256, 273, 408, 412, 415, 285

[56] References Cited

U.S. PATENT DOCUMENTS

| | | | |
|---|---|---|---|
| 5,102,563 | 4/1992 | Desbendras et al. | 252/171 |
| 5,104,565 | 4/1992 | Magid et al. | 252/171 |
| 5,106,526 | 4/1992 | Magid et al. | 252/171 |
| 5,116,426 | 5/1992 | Asano et al. | 252/171 |
| 5,116,525 | 5/1992 | Merchant | 252/171 |
| 5,116,526 | 5/1992 | Magid et al. | 252/172 |
| 5,118,437 | 6/1992 | Magid et al. | 252/171 |
| 5,118,438 | 6/1992 | Magid et al. | 252/172 |
| 5,120,462 | 6/1992 | Buchwald et al. | 252/171 |
| 5,124,065 | 6/1992 | Magid et al. | 252/171 |
| 5,135,676 | 8/1992 | Buchwald et al. | 252/171 |

FOREIGN PATENT DOCUMENTS

| | | |
|---|---|---|
| 450854 | 10/1991 | European Pat. Off. . |
| 450856 | 10/1991 | European Pat. Off. . |
| 90/08814 | 8/1990 | WIPO . |

*Primary Examiner*—Douglas J. McGinty
*Attorney, Agent, or Firm*—Colleen D. Szuch; Jay P. Friedenson

[57] ABSTRACT

Stable azeotrope-like compositions consisting essentially of dichloropentafluoropropane and a hydrocarbon containing six carbon atoms which are useful in a variety of industrial cleaning applications including cold cleaning and defluxing of printed circuit boards.

8 Claims, No Drawings

AZEOTROPE-LIKE COMPOSITIONS OF DICHLOROPENTAFLUOROPROPANE AND METHYLPENTANE

This is a continuation of application Ser. No. 526,874, filed May 22, 1990, now U.S. Pat. No. 5,118,438 which is a continuation-in-part of: U.S. application Ser. No.: 417,951, filed Oct. 6, 1989, abandoned; U.S. application Ser. No. 418,050, filed Oct. 6, 1989, abandoned; and U.S. application Ser. No. 454,789, filed Dec. 21, 1989, abandoned.

FIELD OF THE INVENTION

This invention relates to azeotrope-like mixtures of dichloropentafluoropropane and a hydrocarbon containing six carbon atoms. These mixtures are useful in a variety of vapor degreasing, cold cleaning, and solvent cleaning applications including defluxing and dry cleaning.

CROSS-REFERENCE TO RELATED APPLICATIONS

Co-pending, commonly assigned patent application Ser. No. 418,059, filed Oct. 6, 1989, discloses azeotrope-like mixtures of 1,1-dichloro-2,2,3,3,3-pentafluoropropane and alkane having six carbon atoms.

Co-pending, commonly assigned patent application Ser. No. 417,951, filed Oct. 6, 1989, discloses azeotrope-like mixtures of 1,3-dichloro-1,1,2,2,3-pentafluoropropane and cyclohexane.

Co-pending, commonly assigned patent application Ser. No. 454,789, filed Dec. 21, 1989, discloses azeotrope-like mixtures of dichloropentafluoropropane and cyclohexane.

BACKGROUND OF THE INVENTION

Fluorocarbon based solvents have been used extensively for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must be done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with cloths soaked in solvents and allowed to air dry.

Recently, nontoxic nonflammable fluorocarbon solvents like trichlorotrifluoroethane, have been used extensively in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts, etc.

The art has looked towards azeotropic compositions having fluorocarbon components because the fluorocarbon components contribute additionally desired characteristics, like polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Therefore, unless the solvent composition is essentially constant boiling, fractionation will occur and undesirable solvent distribution may act to upset the cleaning and safety of processing. Preferential evaporation of the more volatile components of the solvent mixtures, which would be the case if they were not an azeotrope or azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotropic mixtures or azeotrope-like mixtures which offer alternatives for new and special applications for vapor degreasing and other cleaning applications. Currently, fluorocarbon-based azeotrope-like mixtures are of particular interest because they are considered to be stratospherically safe substitutes for presently used fully halogenated chlorofluorocarbons. The latter have been implicated in causing environmental problems associated with the depletion of the earth's protective ozone layer. Mathematical models have substantiated that hydrochlorofluorocarbons, like dichloropentafluoropropane, have a much lower ozone depletion potential and global warming potential than the fully halogenated species.

Accordingly, it is an object of the present invention to provide novel environmentally acceptable azeotrope-like compositions which are useful in a variety of industrial cleaning applications.

It is another object of this invention to provide azeotrope-like compositions which are liquid at room temperature and which will not fractionate under conditions of use.

Other objects and advantages of the invention will become apparent from the following description.

SUMMARY OF THE INVENTION

The invention relates to novel azeotrope-like compositions which are useful in a variety of industrial cleaning applications. Specifically the invention relates to compositions of dichloropentafluoropropane and a hydrocarbon containing six carbon atoms which are essentially constant boiling, environmentally acceptable and which remain liquid at room temperature.

DETAILED DESCRIPTION OF THE INVENTION

In accordance with the invention, novel azeotrope-like compositions have been discovered consisting essentially of from about 72 to about 99.99 weight percent dichloropentafluoropropane and from about 0.01 to about 28 weight percent of a hydrocarbon containing six carbon atoms (HEREINAFTER referred to as "$C_6$ hydrocarbon") wherein the azeotrope-like components of the composition consist of dichloropentafluoropropane and a $C_6$ hydrocarbon and boil at about 52.5° C.±about 3.5° C. at 748 mm Hg and preferably boil at about 52.3° C.±about 3.3° C. and more preferably±about 2.9° C.

As used herein, the term "$C_6$ hydrocarbon" shall refer to aliphatic hydrocarbons having the empirical formula $C_6H_{14}$ and cycloaliphatic or substituted cycloaliphatic hydrocarbons having the empirical formula $C_6H_{12}$; and mixtures thereof. Preferably, the term $C_6$ hydrocarbon refers to the following subset including: n-hexane, 2-methylpentane, 3-methylpentane, 2,2-dimethylbutane, 2,3-dimethylbutane, methylcyclopentane, cyclohexane, commercial isohexane* (typically, the percentages of the isomers in commercial isohexane will fall into one of the two following formulations designated grade 1 and grade 2: grade 1:35–75 weight percent 2-methylpentane, 10–40 weight percent 3-methylpentane, 7–30 weight percent 2,3-dimethylbutane, 7–30 weight percent 2,2-dimethylbutane, and 0.1–10 weight percent n-hexane, and up to about 5 weight percent other alkane isomers; the sum of the branched chain six carbon alkane isomers is about 90 to about 100 weight percent and the sum of the branched and straight chain six carbon alkane isomers is about 95 to about 100 weight percent; grade 2: 40–55 weight percent 2-methylpentane, 15–30 weight percent 3-methylpentane, 10–22 weight percent 2,3-dimethylbutane, 9–16 weight percent 2,2-dimethylbutane, and 0.1–5 weight percent n-hexane; the sum of the branched chain six carbon alkane isomers is about 95 to about 100 weight percent and the sum of the branched and straight chain six carbon alkane isomers is about 97 to about 100 weight percent) and mixtures thereof.

*Commercial isohexane is available through Phillips 66. This compound nominally contains the following compounds (wt. %): 0.3% $C_5$ alkanes, 13.5% 2,2-dimethylbutane, 14.4% 2,3-dimethylbutane, 46.5% 2-methylpentane, 23.5% 3-methylpentane, 0.9% n-hexane and 0.9% lights unknown.

Dichloropentafluoropropane exists in nine isomeric forms: (1) 2,2-dichloro-1,1,1,3,3-pentafluoro-propane (HCFC-225a); (2) 1,2-dichloro-1,2,3,3,3-pentafluoropropane (HCFC-225ba); (3) 1,2-dichloro-1,1,2,3,3-pentafluoropropane (HCFC-225bb); (4) 1,1-dichloro-2,2,3,3,3-pentafluoropropane (HCFC-225ca); (5) 1,3-dichloro-1,1,2,2,3-pentafluoropropane (HCFC-225cb); (6) 1,1-dichloro-1,2,2,3,3-pentafluoropropane (HCFC-225cc); (7) 1,2-dichloro-1,1,3,3,3pentafluoropropane (HCFC-225d); (8) 1,3-dichloro-1,1,2,3,3-pentafluoropropane (HCFC-225ea); and (9) 1,1-dichloro-1,2,3,3,3-pentafluoropropane (HCFC-225eb). For purposes of this invention, dichloropentafluoropropane will refer to any of the isomers or an admixture of the isomers in any proportion. The 1,1-dichloro-2,2,3,3,3-pentafluoropropane and 1,3-dichloro-1,1,2,2,3-pentafluoropropane isomers, however, are the preferred isomers.

The dichloropentafluoropropane component of the invention has good solvent properties. The hydrocarbon component also has good solvent capabilities; enhancing the solubility of oils. Thus, when these components are combined in effective amounts, an efficient azeotropic solvent results.

When the $C_6$ hydrocarbon is 2-methylpentane, the azeotrope-like compositions of the invention consist essentially of from about 72 to about 92 weight percent dichloropentafluoropropane and from about 8 to about 28 weight percent 2-methylpentane and boil at about 51.1° C.±about 1.8° C. at 750 mm Hg.

when the $C_6$ hydrocarbon is 3-methylpentane, the azeotrope-like compositions of the invention consist essentially of from about 74 to about 96 weight percent dichloropentafluoropropane and from about 4 to about 26 weight percent 3-methylpentane and boil at about 51.6° C.±about 2.1° C. at 745 mm Hg.

When the $C_6$ hydrocarbon is commercial isohexane grade 1, the azeotrope-like compositions of the invention consist essentially of from about 72 to about 92 weight percent dichloropentafluoropropane and from about 8 to about 28 weight percent commercial isohexane grade 1 and boil at about 50.5° C.±about 2.5° C. at 750 mm Hg.

When the $C_6$ hydrocarbon is commercial isohexane grade 2, the azeotrope-like compositions of the invention consist essentially of from about 72 to about 92 weight percent dichloropentafluoropropane and from about 8 to about 28 weight percent commercial isohexane grade 2 and boil at about 50.5° C.±about 2.5° C. at 750 mm Hg.

when the $C_6$ hydrocarbon is n-hexane, the azeotrope-like compositions of the invention consist essentially of from about 77.5 to about 99.5 weight percent dichloropentafluoropropane and from about 0.5 to about 22.5 weight percent n-hexane and boil at about 53.2° C.±about 2.2° C. at 760 mm Hg.

When the $C_6$ hydrocarbon is methylcyclopentane, the azeotrope-like compositions of the invention consist essentially of from about 85 to about 99.99 weight percent dichloropentafluoropropane and from about 0.01 to about 15 weight percent methylcyclopentane and boil at about 52.7° C.±about 2.4° C. at 745 mm Hg.

When the $C_6$ hydrocarbon is cyclohexane, the azeotrope-like compositions of the invention consist essentially of from about 90 to about 99.99 weight percent dichloropentafluoropropane and from about 0.01 to about 10 weight percent cyclohexane and boil at about 53.5° C.±about 2.7° C. at 760 mm Hg.

When the dichloropentafluoropropane component is 225ca and the $C_6$ hydrocarbon is cyclohexane, the azeotrope-like compositions of the invention consist essentially of from about 94 to about 99.99 weight percent 1,1-dichloro-2,2,3,3,3-pentafluoropropane and from about 0.01 to about 6 weight percent cyclohexane and boil at about 50.6° C.±about 0.5° C. and preferably±about 0.3° C. and more preferably±about 0.2° C. at 748 mm Hg.

In a preferred embodiment of the invention utilizing 225ca and cyclohexane, the azeotrope-like compositions consist essentially of from about 95 to about 99.99 weight percent 1,1-dichloro-2,2,3,3,3-pentafluoropropane and from about 0.01 to about 5 weight percent cyclohexane.

In the most preferred embodiment of the invention utilizing 225ca and cyclohexane, the azeotrope-like compositions consist essentially of from about 96 to about 99.99 weight percent 1,1-dichloro-2,2,3,3,3-pentafluoropropane and from about 0.01 to about 4 weight percent cyclohexane.

In another embodiment of the invention utilizing 225ca and cyclohexane, the azeotrope-like compositions consist essentially of from about 97 to about 99.99 weight percent 1,1-dichloro-2,2,3,3,3-pentafluoropropane and from about 0.01 to about 3 weight percent cyclohexane.

In yet another embodiment of the invention utilizing

225ca and cyclohexane, the azeotrope-like compositions consist essentially of from about 98 to about 99.99 weight percent 1,1-dichloro-2,2,2,3,3-pentafluoropropane and from about 0.01 to about 2 weight percent cyclohexane.

When the dichloropentafluoropropane component is 225ca and the $C_6$ hydrocarbon is 2-methylpentane, the azeotrope-like compositions of the invention consist essentially of from about 83 to about 94 weight percent 1,1-dichloro-2,2,3,3,3-pentafluoropropane and from about 6 to about 17 weight percent 2-methylpentane and boil at about 49.8° C.±about 0.5° C. 751 mm Hg.

In a preferred embodiment utilizing 225ca and 2-methylpentane, the azeotrope-like compositions of the invention consist essentially of from about 85 to about 92 weight percent 1,1-dichloro-2,2,3,3,3-pentafluoropropane and from about 8 to about 15 weight percent 2-methylpentane.

In a more preferred embodiment utilizing 225ca and 2-methylpentane, the azeotrope-like compositions of the invention consist essentially of from about 85 to about 91 weight percent 1,1-dichloro-2,2,3,3,3-pentafluoropropane and from about 9 to about 15 weight percent 2-methylpentane.

When the dichloropentafluoropropane component is 225ca and the $C_6$ hydrocarbon is 3-methylpentane, the azeotrope-like compositions of the invention consist essentially of from about 85.5 to about 96.5 weight percent 1,1-dichloro-2,2,3,3,3-pentafluoropropane and from about 3.5 to about 14.5 weight percent 3-methylpentane and boil at about 50.0° C.±about 0.5° C. at 744 mm Hg.

In a preferred embodiment utilizing 225ca and 3-methylpentane, the azeotrope-like compositions of the invention consist essentially of from about 88 to about 95.5 weight percent 1,1-dichloro-2,2,3,3,3-pentafluoropropane and from about 4.5 to about 12 weight percent 3-methylpentane.

When the dichloropentafluoropropane component is 225ca and the $C_6$ hydrocarbon is n-hexane, the azeotrope-like compositions of the invention consist essentially of from about 94 to about 99.5 weight percent 1,1-dichloro-2,2,3,3,3-pentafluoropropane and from about 0.5 to about 6 weight percent n-hexane and boil at about 50.5° C.±about 0.2° C. at 746 mm Hg.

In a preferred embodiment utilizing 225ca and n-hexane, the azeotrope-like compositions of the invention consist essentially of from about 95 to about 99.5 weight percent 1,1-dichloro-2,2,3,3,3-pentafluoropropane and from about 0.5 to about 5 weight percent n-hexane.

In a more preferred embodiment utilizing 225ca and n-hexane, the azeotrope-like compositions of the invention consist essentially of from about 95 to about 99 weight percent 1,1-dichloro-2,2,3,3,3-pentafluoropropane and from about 1 to about 5 weight percent n-hexane.

When the dichloropentafluoropropane component is 225ca and the $C_6$ hydrocarbon is commercial isohexane grade 1, the azeotrope-like compositions of the invention consist essentially of from about 77 to about 92.5 weight percent 1,1-dichloro-2,2,3,3,3-pentafluoropropane and from about 7.5 to about 23 weight percent commercial isohexane grade 1 and boil at about 48.5° C.±about 1.5° C. at 737 mm Hg.

In a preferred embodiment utilizing 225ca and commercial isohexane grade 1, the azeotrope-like compositions of the invention consist essentially of from about 80 to about 91 weight percent 1,1-dichloro-2,2,3,3,3-pentafluoropropane and from about 9 to about 20 weight percent commercial isohexane grade 1.

In a more preferred embodiment utilizing 225ca and commercial isohexane grade 1, the azeotrope-like compositions of the invention consist essentially of from about 82 to about 90 weight percent 1,1-dichloro-2,2,3,3,3-pentafluoropropane and from about 10 to about 18 weight percent commercial isohexane grade 1.

When the dichloropentafluoropropane component is 225ca and the $C_6$ hydrocarbon is commercial isohexane grade 2, the azeotrope-like compositions of the invention consist essentially of from about 77 to about 92.5 weight percent 1,1-dichloro-2,2,3,3,3-pentafluoropropane and from about 7.5 to about 23 weight percent commercial isohexane grade 2 and boil at about 48.5° C.±about 1.5° C. at 737 mm Hg.

In a preferred embodiment utilizing 225ca and commercial isohexane grade 2, the azeotrope-like compositions of the invention consist essentially of from about 80 to about 91 weight percent 1,1-dichloro-2,2,3,3,3-pentafluoropropane and from about 9 to about 20 weight percent commercial isohexane grade 2.

In a more preferred embodiment utilizing 225ca and commercial isohexane grade 2, the azeotrope-like compositions of the invention consist essentially of from about 82 to about 90 weight percent 1,1-dichloro-2,2,3,3,3-pentafluoropropane and from about 10 to about 18 weight percent commercial isohexane grade 2.

When the dichloropentafluoropropane component is 225ca and the $C_6$ hydrocarbon is methylcyclopentane, the azeotrope-like compositions of the invention consist essentially of from about 93 to about 99.99 weight percent 1,1-dichloro-2,2,3,3,3-pentafluoropropane and from about 0.01 to about 7 weight percent methylcyclopentane and boil at about 50.5° C.±about 0.3° C. and preferably±about 0.2° C. and more preferably±about 0.1° C. at 743.9 mm Hg.

In a preferred embodiment utilizing 225ca and methylcyclopentane, the azeotrope-like compositions of the invention consist essentially of from about 95 to about 99.99 weight percent 1,1-dichloro-2,2,3,3,3-pentafluoropropane and from about 0.01 to about 5 weight percent methylcyclopentane.

In a more preferred embodiment utilizing 225ca and methylcyclopentane, the azeotrope-like compositions of the invention consist essentially of from about 96 to about 99.99 weight percent 1,1-dichloro-2,2,3,3,3-pentafluoropropane and from about 0.01 to about 4 weight percent methylcyclopentane.

When the dichloropentafluoropropane component is 225cb and the $C_6$ hydrocarbon is 2-methylpentane, the azeotrope-like compositions of the invention consist essentially of from about 68 to about 85 weight percent 1,3-dichloro-1,1,2,2,3-pentafluoropropane and from about 15 to about 32 weight percent 2-methylpentane and boil at about 52.7° C.±about 0.4° C. and preferably±about 0.3° C. and more preferably±about 0.2° C. at 750.4 mm Hg.

In a preferred embodiment utilizing 225cb and 2-methylpentane, the azeotrope-like compositions of the invention consist essentially of from about 71 to about 83 weight percent 1,3-dichloro-1,1,2,2,3-pentafluoropropane and from about 17 to about 29 weight percent 2-methylpentane.

When the dichloropentafluoropropane component is 225cb and the $C_6$ hydrocarbon is 3-methylpentane, the azeotrope-like compositions of the invention consist essentially of from about 71 to about 90 weight percent 1,3-dichloro-1,1,2,2,3-pentafluoropropane and from about 10 to about 29 weight percent 3-methylpentane and boil at about 53.4° C.±about 0.4° C. and preferably±about 0.3° C. and more preferably±about 0.2° C. at 744.1 mm Hg.

In a preferred embodiment utilizing 225cb and 3-methylpentane, the azeotrope-like compositions of the invention consist essentially of from about 74 to about 88 weight percent 1,3-dichloro-1,1,2,2,3-pentafluoropropane and from about 12 to about 26 weight percent 3-methylpentane.

When the dichloropentafluoropropane component is 225cb and the $C_6$ hydrocarbon is methylcyclopentane, the azeotrope-like compositions of the invention consist essentially of from about 83.5 to about 96.5 weight percent 1,3-dichloro-1,1,2,2,3-pentafluoropropane and from about 3.5 to about 16.5 weight percent methylcyclopentane and boil at about 54.8° C.±about 0.4° C. and preferably±about 0.3° C. and more preferably±at 746.2 mm Hg.

In a preferred embodiment utilizing 225cb and methylcyclopentane, the azeotrope-like compositions of the invention consist essentially of from about 85 to about 96 weight percent 1,3-dichloro-1,1,2,2,3-pentafluoropropane and from about 4 to about 15 weight percent methylcyclopentane.

In a more preferred embodiment utilizing 225cb and methylcyclopentane, the azeotrope-like compositions of the invention consist essentially of from about 86.5 to about 95 weight percent 1,3-dichloro-1,1,2,2,3-pentafluoropropane and from about 5 to about 13.5 weight percent methylcyclopentane.

When the dichloropentafluoropropane component is 225cb and the $C_6$ hydrocarbon is n-hexane, the azeotrope-like compositions of the invention consist essentially of from about 76.5 to about 88.5 weight percent 1,3-dichloro-1,1,2,2,3-pentafluoropropane and from about 11.5 to about 23.5 weight percent n-hexane and boil at about 54.9° C.±about 0.4° C. and preferably±about 0.3° C. and more preferably±about 0.2° C. at 756.4 mm Hg.

In a preferred embodiment utilizing 225cb and n-hexane, the azeotrope-like compositions of the invention consist essentially of from about 77.5 to about 87.5 weight percent 1,3-dichloro-1,1,2,2,3-pentafluoropropane and from about 12.5 to about 22.5 weight percent n-hexane.

When the dichloropentafluoropropane component is 225cb and the $C_6$ hydrocarbon is commercial isohexane grade 1, the azeotrope-like compositions of the invention consist essentially of from about 68 to about 85 weight percent 1,3-dichloro-1,1,2,2,3-pentafluoropropane and from about 15 to about 32 weight percent commercial isohexane grade 1 and boil at about 51.5° C.±about 1.5° C. and preferably±about 1.0° C. and more preferably±about 0.5° C. at 750.4 mm When the dichloropentafluoropropane component is 225cb and the $C_6$ hydrocarbon is commercial isohexane grade 2, the azeotrope-like compositions of the invention consist essentially of from about 68 to about 85 weight percent 1,3-dichloro-1,1,2,2,3-pentafluoropropane and from about 15 to about 32 weight percent commercial isohexane grade 2 and boil at about 51.5° C.±about 1.5° C. and preferably±about 1.0° C. and more preferably±about 0.5° C. at 750.4 mm Hg.

When the dichloropentafluoropropane component is 225cb and the $C_6$ hydrocarbon is cyclohexane the azeotrope-like compositions of the invention consist essentially of from about 90 to about 99 weight percent 1,3-dichloro-1,1,2,2,3-pentafluoropropane and from about 1 to about 10 weight percent cyclohexane and boil at about 55.9° C.±about 0.2° C. at 761 mm Hg.

In a preferred embodiment utilizing 225cb and cyclohexane the azeotrope-like compositions of the invention consist essentially of from about 90.5 to about 98 weight percent 1,3-dichloro-1,1,2,2,3pentafluoropropane and from about 2 to about 9.5 weight percent cyclohexane.

In a more preferred embodiment utilizing 225cb and cyclohexane the azeotrope-like compositions of the invention consist essentially of from about 90.5 to about 97 weight percent 1,3-dichloro-1,1,2,2,3-pentafluoropropane and from about 3 to about 9.5 weight percent cyclohexane.

In the most preferred embodiment utilizing 225cb and cyclohexane the azeotrope-like compositions of the invention consist essentially of from about 90.5 to about 96 weight percent 1,3-dichloro-1,1,2,2,3-pentafluoropropane and from about 4 to about 9.5 weight percent cyclohexane.

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at a stated P and T. In practice, this means that the components of a mixture cannot be separated during distillation, and therefore are useful in vapor phase solvent cleaning as described above.

For purposes of this discussion, by azeotrope-like composition is intended to mean that the composition behaves like a true azeotrope in terms of its constant-boiling characteristics or tendency not to fractionate upon boiling or evaporation. Such compositions may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only minimally. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution—number of plates) which would be expected to separate the mixture into its separate components. If the mixture is non-azeotropic or non-azeotrope-like, the mixture will fractionate, i.e., separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like, i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly as does the boiling point of the composition. Thus, an azeotrope of A and B represents a unique type of relationship but with a variable composition depending on temperature and/or pressure. Accordingly, another way of defining azeotrope-like within the meaning of the invention is to state that such mixtures boil within about±3.5° C. (at 760 mm Hg) of the 52.5° C. boiling point disclosed herein. As is readily understood by persons skilled in the art, the boiling point of the azeotrope will vary with the pressure.

In the process embodiment of the invention, the azeotrope-like compositions of the invention may be used to clean solid surfaces by treating said surfaces with said compositions in any manner well known in the art such as by dipping or spraying or use of conventional degreasing apparatus.

As stated above, the azeotrope-like compositions discussed herein are useful as solvents for various cleaning applications including vapor degreasing, defluxing, cold cleaning, dry cleaning, dewatering, decontamination, spot cleaning, aerosol propelled rework, extraction, particle removal, and surfactant cleaning applications. These azeotrope-like compositions are also useful as blowing agents, Rankine cycle and absorption refrigerants, and power fluids.

The dichloropentafluoropropane and $C_6$ hydrocarbon components of the invention are known materials. Preferably, they should be used in sufficiently high purity so as to avoid the introduction of adverse influences upon the solvent or constant boiling properties of the system.

Commercially available $C_6$ hydrocarbons may be used in the present invention. Most dichloropentafluoropropane isomers, like the preferred HCFC-225ca isomer, are not available in commercial quantities, therefore until such time as they become commercially available, they may be prepared by following the organic syntheses disclosed herein. For example, 1,1-dichloro-2,2,3,3,3-pentafluoropropane may be prepared by reacting 2,2,3,3,3-pentafluoro-1-propanol and p-toluenesulfonate chloride together to form 2,2,3,3,3-pentafluoropropyl-p-toluenesulfonate. Next, N-methylpyrrolidone, lithium chloride, and the 2,2,3,3,3,-pentafluoropropyl-p-toluenesulfonate are reacted together to form 1-chloro-2,2,3,3,3-pentafluoropropane. Finally, chlorine and 1-chloro-2,2,3,3,3-pentafluoropropane are reacted together to form 1,1-dichloro-2,2,3,3,3-pentafluoropropane. A detailed synthesis is set forth in Example 1.

Synthesis of 2,2-dichloro-1,1,1,3,3-pentafluoropropane (225a). This compound may be prepared by reacting a dimethylformamide solution of 1,1,1-trichloro-2,2,2-trifluoromethane with chlorotrimethylsilane in the presence of zinc, forming 1-(trimethylsiloxy)-2,2-dichloro-3,3,3-trifluoro-N,N-dime thylpropylamine. The 1-(trimethylsiloxy)-2,2-dichloro-3,3,3-trifluoro-N,N-dimethyl propylamine is reacted with sulfuric acid to form 2,2-dichloro-3,3,3-trifluoropropionaldehyde. The 2,2-dichloro-3,3,3-trifluoropropionaldehyde is then reacted with sulfur tetrafluoride to produce 2,2-dichloro-1,1,1,3,3-pentafluoropropane.

Synthesis of 1,2-dichloro-1,2,3,3,3-pentafluoropropane (225ba). This isomer may be prepared by the synthesis disclosed by O. Paleta et al., Bull. Soc. Chim. Fr., (6) 920–4 (1986).

Synthesis of 1,2-dichloro-1,1,2,3,3-pentafluoropropane (225bb). The synthesis of this isomer is disclosed by M. Hauptschein and L. A. Bigelow, J. Am. Chem. Soc., (73) 1428–30 (1951). The synthesis of this compound is also disclosed by A. H. Fainberg and W. T. Miller, Jr., J. Am. Chem. Soc., (79) 4170–4, (1957).

Synthesis of 1,3-dichloro-1,1,2,2,3-pentafluoropropane (225cb). The synthesis of this compound involves four steps.

Part A—Synthesis of 2,2,3,3-tetrafluoropropyl-p-toluenesulfonate. 406 gm (3.08 mol) 2,2,3,3-tetrafluoropropanol, 613 gm (3.22 mol) tosylchloride, and 1200 ml water were heated to 50° C. with mechanical stirring. Sodium hydroxide (139.7 gm, 3.5 ml) in 560 ml water was added at a rate such that the temperature remained less than 65° C. After the addition was completed, the mixture was stirred at 50° C. until the pH of the aqueous phase was 6. The mixture was cooled and extracted with 1.5 liters methylene chloride. The organic layer was washed twice with 200 ml aqueous ammonia, 350 ml water, dried with magnesium sulfate, and distilled to give 697.2 gm (79%) viscous oil.

Part B—Synthesis of 1,1,2,2,3-pentafluoropropane. A 500 ml flask was equipped with a mechanical stirrer and a Vigreaux distillation column, which in turn was connected to a dry-ice trap, and maintained under a nitrogen atmosphere. The flask was charged with 400 ml N-methylpyrrolidone, 145 gm (0.507 mol) 2,2,3,3-tetrafluoropropyl-p-toluenesulfonate (produced in Part A above), and 87 gm (1.5 mol) spray-dried KF. The mixture was then heated to 190°–200° C. for about 3.25 hours during which time 61 gm volatile product distilled into the cold trap (90% crude yield). Upon distillation, the fraction boiling at 25°–28° C. was collected.

Part C—Synthesis of 1,1,3-trichloro-1,2,2,3,3pentafluoropropane. A 22 liter flask was evacuated and charged with 20.7 gm (0.154 mol) 1,1,2,2,3-pentafluoropropane (produced in Part B above) and 0.6 mol chlorine. It was irradiated 100 minutes with a 450 W Hanovia Hg lamp at a distance of about 3 inches (7.6 cm). The flask was then cooled in an ice bath, nitrogen being added as necessary to maintain 1 atm (101 kPa). Liquid in the flask was removed via syringe. The flask was connected to a dry-ice trap and evacuated slowly (15–30 minutes). The contents of the dry-ice trap and the initial liquid phase totaled 31.2 g (85%), the GC purity being 99.7%. The product from several runs was combined and distilled to provide a material having b.p. 73.5°–74° C.

Part D—Synthesis of 1,3-dichloro-1,1,2,2,3pentafluoropropane. 106.6 gm (0.45 mol) of 1,1,3-trichloro-1,2,2,3,3-pentafluoropropane (produced in Part C above) and 300 gm (5 mol) isopropanol were stirred under an inert atmosphere and irradiated 4.5 hours with a 450 W Hanovia Hg lamp at a distance of 2–3 inches (5–7.6 cm). The acidic reaction mixture was then poured into 1.5 liters ice water. The organic layer was separated, washed twice with 50 ml water, dried with calcium sulfate, and distilled to give 50.5 gm $ClCF_2CF_2CHClF$, bp 54.5°–56° C. (55%). $^1H$ NMR ($CDCl_3$): ddd centered at 6.43 ppm. J H-C-F=47 Hz, J H-C-C-Fa=12 Hz, J H-C-C-Fb=2 Hz.

Synthesis of 1,1-dichloro-1,2,2,3,3-pentafluoropropane (225cc). This compound may be prepared by reacting 2,2,3,3-tetrafluoro-1-propanol and p-toluenesulfonate chloride to form 2,2,3,3-tetrafluoropropyl-p-toluesulfonate. Next, the 2,2,3,3-tetrafluoropropyl-p-toluenesulfonate is reacted with potassium fluoride in N-methylpyrrolidone to form 1,1,2,2,3-pentafluoropropane. Then, the 1,1,2,2,3-pentafluoropropane is reacted with chlorine to form 1,1-dichloro-1,2,2,3,3-pentafluoropropane.

Synthesis of 1,2-dichloro-1,1,3,3,3-pentafluoropropane (225d). This isomer is commercially available from P.C.R. Incorporated of Gainsville, Fla. Alternately, this compound may be prepared by adding equimolar amounts of 1,1,1,3,3-pentafluoropropane and chlorine gas to a borosilicate flask that has been purged of air. The flask is then irradiated with a mercury lamp. Upon completion of the irradiation, the contents of the flask are cooled. The resulting product will be 1,2-dichloro-1,1,3,3,3-pentafluoropropane.

Synthesis of 1,3-dichloro-1,1,2,3,3-pentafluoropropane (225ea). This compound may be prepared by reacting trifluoroethylene with dichlorotrfluoromethane to produce 1,3-dichloro-1,1,2,3,3,pentafluoropropane and 1,1-dichloro-1,2,3,3,3-pentafluoropropane. The 1,3-dichloro-1,1,2,3,3-pentafluoropropane is separated from its isomers using fractional distillation and/or preparative gas chromatography.

Synthesis of 1,1,-dichloro-1,2,3,3,3-pentafluoropropane (225eb). This compound may be prepared by reacting trifluoroethylene with dichlorodifluoromethane to produce 1,3-dichloro-1,1,2,3,3-pentafluoropropane and 1,1-dichloro-1,2,3,3,3-pentafluoropropane. The 1,1-dichloro-1,2,3,3,3-pentafluoropropane is separated from its isomer using fractional distillation and/or preparative gas chromatography. Alternatively, 225eb may be prepared by a synthesis disclosed by O. Paleta et al., Bull. Soc. Chim. Fr., (6) 920–4 (1986). The 1,1-dichloro-1,2,3,3,3-pentafluoropropane can be separated from its two isomers using fractional distillation and/or preparative gas chromatography.

It should be understood that the present compositions may include additional components which form new azeotrope-like compositions. Any such compositions are considered to be within the scope of the present invention as long as the compositions are constant-boiling or essentially constant-boiling and contain all of the essential components described herein.

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: epoxy compounds such as propylene oxide; nitroalkanes such as nitromethane; ethers such as 1–4-dioxane; unsaturated compounds such as 1,4-butyne diol; acetals or ketals such as dipropoxy methane; ketones such as methyl ethyl ketone; alcohols such as tertiary amyl alcohol; esters such as triphenyl phosphite; and amines such as triethyl amine. Other suitable inhibitors will readily occur to those skilled in the art.

Having described the invention in detail and by reference to preferred embodiments thereof, it will be apparent that modifications and variations are possible without departing from the scope of the invention defined in the appended claims.

The present invention is more fully illustrated by the following non-limiting Examples.

EXAMPLE 1

This example is directed to the preparation of the preferred dichloropentafluoropropane component of the invention 1,1-dichloro-2,2,3,3,3-pentafluoropropane (225ca).

Part A—Synthesis of 2,2,3,3,3-pentafluoropropyl-p-toluenesulfonate. To p-toluenesulfonate chloride (400.66 g, 2.10 mol) in water at 25° C. was added 2,2,3,3,3-pentafluoro-1-propanol(300.8 g). The mixture was heated to 50° C. in a 5 liter, 3-neck separatory funnel-type reaction flask, under mechanical stirring. Sodium hydroxide(92.56 g, 2.31 mol) in 383 ml water(6M solution) was added dropwise to the reaction mixture via addition funnel over a period of 2.5 hours, keeping the temperature below 55° C. Upon completion of this addition, when the pH of the aqueous phase was approximately 6, the organic phase was drained from the flask while still warm, and allowed to cool to 25° C. The crude product was recrystallized from petroleum ether to afford 500.7 gm (1.65 mol, 82.3%) white needles of 2,2,3,3,3-pentafluoropropyl-p-toluenesulfonate (mp 47.0°–52.5° C.). $^1$H NMR: 2.45 ppm (S,3H), 4.38 ppm (t,2H, J=12 Hz), 7.35 ppm (d,2H, J=6 Hz); $^{19}$F NMR: +83.9 ppm (S,3F), +123.2 (t,2F,J=12 Hz), upfield from $CFCl_3$.

Part B—Synthesis of 1-chloro-2,2,3,3,3-pentafluoropropane. A 1 liter flask fitted with a thermometer, Vigreaux column and distillation receiving head was charged with 248.5 g (0.82 mol) 2,2,3,3,3-pentafluoropropyl-p-toluenesulfonate(produced in Part A above), 375 ml N-methylpyrrolidone, and 46.7 g (1.1 mol) lithium chloride. The mixture was then heated with stirring to 140° C. at which point, product began to distill over. Stirring and heating were continued until a pot temperature of 198° C. had been reached at which point, there was no further distillate being collected. The crude product was re-distilled to give 107.2 g (78%) of product (bp 27.5°–28° C.). $^1$H NMR: 3.81 ppm (t,J=13.5 Hz) $^{19}$F NMR: 83.5 and 119.8 ppm upfield from $CFCl_3$.

Part C—Synthesis of 1,1-dichloro-2,2,3,3,3-pentafluoropropane. Chlorine(289 ml/min) and 1-chloro-2,2,3,3,3-pentafluoro-propane (produced in Part B above), (1.72 g/min) were fed simultaneously into a 1 inch(2.54 cm)×2 inches (5.08 cm) monel reactor at 300° C. The process was repeated until 184 g crude product had collected in the cold traps exiting the reactor. After washing the crude product with 6M sodium hydroxide and drying with sodium sulfate, it was distilled to give 69.2 g starting material and 46.8 g 1,1-dichloro-2,2,3,3,3-pentafluoropropane (bp 48°–50.5° C.).$^1$H NMR: 5.9 (t, J=7.5 H) ppm; $^{19}$ F NMR: 79.4 (3F) and 119.8 (2F) ppm upfield from $CFCl_3$.

EXAMPLE 2

The compositional range over which 225ca and cyclohexane exhibit constant boiling behavior was determined. This was accomplished by charging measured quantities of 225ca into an ebulliometer. The ebulliometer consisted of a heated sump in which the HCFC-225ca was brought to a boil. The upper part of the ebulliometer connected to the sump was cooled thereby acting as a condenser for the boiling vapors, allowing the system to operate at total reflux. After bringing the HCFC-225ca to a boil at atmospheric pressure, measured amounts of cyclohexane were titrated into the ebulliometer. The change in boiling point was measured with a platinum resistance thermometer.

The results indicate that compositions of 225ca/cyclohexane ranging from 94–99.99/0.01–6 weight percent respectively would exhibit constant boiling behavior at 50.6° C.±about 0.5° C. at 748 mm Hg.

EXAMPLES 3–12

The azeotropic properties of the dichloropentafluoropropane isomers and $C_6$ hydrocarbons listed in Table I were studied. This was accomplished by charging measured quantities of dichloropentafluoropropane (from column A) into an ebulliometer. The dichloropentafluoropropane component was brought to a boil. The upper part of the ebulliometer connected to the sump was cooled thereby acting as a condenser for the boiling vapors, allowing the system to operate at total reflux. After bringing the dichloropentafluoropropane component to a boil at atmospheric pressure, measured amounts of $C_6$ hydrocarbon (column B) were titrated into the ebulliometer. The change in boiling point was measured with a platinum resistance thermometer.

The range over which the various mixtures exhibited constant boiling behavior is reported in Table I.

TABLE I

| Ex. | A. Dichloropenta-fluoropropane | B. $C_6$ Hydrocarbon | Constant Boiling Composition (wt %) A. | B. | Constant Boiling Temp.** (°C.) |
|---|---|---|---|---|---|
| 3 | 225ca | n-hexane | 94.0–99.5 | 0.5–6.0 | 50.5 ± 0.2 |
| 4 | 225ca | 2-methyl-pentane | 83.0–94.0 | 6.0–17.0 | 49.8 ± 0.5 |
| 5 | 225ca | 3-methyl-pentane | 85.5–96.5 | 5.5–14.5 | 50.0 ± 0.5 |
| 6 | 225ca | methylcyclo-pentane | 93.0–99.99 | 0.01–7.0 | 50.5 ± 0.3 |
| 7 | 225ca | commercial isohexane* | 77.0–92.5 | 7.5–23.0 | 48.5 ± 1.5 |
| 8 | 225cb | n-hexane | 76.5–88.5 | 11.5–23.5 | 54.9 ± 0.4 |
| 9 | 225cb | 2-methyl-pentane | 68.0–85.0 | 13.0–32.0 | 52.7 ± 0.4 |
| 10 | 225cb | 3-methyl-pentane | 71.0–90.0 | 10.0–29.0 | 53.4 ± 0.4 |
| 11 | 225cb | methylcyclo-pentane | 83.5–96.5 | 3.5–16.5 | 54.8 ± 0.4 |
| 12 | 225cb | cyclohexane | 90.0–99.0 | 1.0–10.0 | 55.9 ± 0.2 |

*Commercial isohexane sold by Phillips 66 was used in this experiment.
**The boiling point determinations for Examples 3–12 were made at the following barometric pressure (mm Hg); 746, 751, 744, 744, 737, 756, 750, 744, 746 and 761 respectively.

EXAMPLES 13–21

The azeotropic properties of the dichloropentafluoropropane components listed in Table II with cyclohexane are studied by repeating the experiment outlined in Examples 3–12 above. In each case a minimum in the boiling point versus composition curve occurs indicating that a constant boiling composition forms between the dichloropentafluoropropane component and cyclohexane.

TABLE II

| Dichloropentafluoropropane Component |
|---|
| 2,2-dichloro-1,1,1,3,3-pentafluoropropane (225a) |
| 1,2-dichloro-1,2,3,3,3-pentafluoropropane (225ba) |
| 1,2-dichloro-1,1,2,3,3-pentafluoropropane (225bb) |
| 1,1-dichloro-1,2,2,3,3-pentafluoropropane (225cc) |
| 1,2-dichloro-1,1,3,3,3-pentafluoropropane (225d) |
| 1,3-dichloro-1,1,2,3,3-pentafluoropropane (225ea) |
| 1,1-dichloro-1,2,3,3,3-pentafluoropropane (225eb) |
| 1,1-dichloro-2,2,3,3,3-pentafluoropropane/(mixture of 1,3-dichloro-1,1,2,2,3-pentafluoropropane 225ca/cb) |
| 1,1-dichloro-1,2,2,3,3,3-pentafluoropropane/(mixture of 1,3-dichloro-1,1,2,2,3-pentafluoropropane (25eb/cb) |

EXAMPLES 22–30

The azeotropic properties of the dichloropentafluoropropane components listed in Table II with n-hexane are studied by repeating the experiment outlined in Examples 3–12 above. In each case a minimum in the boiling point versus composition curve occurs indicating that a constant boiling composition forms between the dichloropentafluoropropane component and n-hexane.

EXAMPLES 31–39

The azeotropic properties of the dichloropentafluoropropane components listed in Table II with 2-methylpentane are studied by repeating the experiment outlined in Examples 3–12 above. In each case a minimum in the boiling point versus composition curve occurs indicating that a constant boiling composition forms between the dichloropentafluoropropane component and 2-methylpentane.

EXAMPLES 40–48

The azeotropic properties of the dichloropentafluoropropane components listed in Table II with 3-methylpentane are studied by repeating the experiment outlined in Examples 3–12 above. In each case a minimum in the boiling point versus composition curve occurs indicating that a constant boiling composition forms between the dichloropentafluoropropane component and 3-methylpentane.

EXAMPLES 49–57

The azeotropic properties of the dichloropentafluoropropane components listed in Table II with methylcyclopentane are studied by repeating the experiment outlined in Examples 3–12 above. In each case a minimum in the boiling point versus composition curve occurs indicating that a constant boiling composition forms between the dichloropentafluoropropane component and methylcyclopentane.

EXAMPLES 58–68

The azeotropic properties of the dichloropentafluoropropane components listed in Table III below with commercial isohexane grade 1 are studied by repeating the experiment outlined in Examples 3–12 above. In each case a minimum in the boiling point versus composition curve occurs indicating that a constant boiling composition forms between the dichloropentafluoropropane component and commercial isohexane grade 1.

TABLE III

| Dichloropentafluoropropane Component |
|---|
| 2,2-dichloro-1,1,1,3,3-pentafluoropropane (225a) |
| 1,2-dichloro-1,2,3,3,3-pentafluoropropane (225ba) |
| 1,2-dichloro-1,1,2,3,3-pentafluoropropane (225bb) |
| 1,1-dichloro-2,2,3,3,3-pentafluoropropane (225ca) |
| 1,3-dichloro-1,1,2,2,3-pentafluoropropane (225cb) |
| 1,1-dichloro-1,2,2,3,3-pentafluoropropane (225cc) |
| 1,2-dichloro-1,1,3,3,3-pentafluoropropane (225d) |
| 1,3-dichloro-1,1,2,3,3-pentafluoropropane (225ea) |
| 1,1-dichloro-1,2,3,3,3-pentafluoropropane (225cb) |
| 1,1-dichloro-2,2,3,3,3-pentafluoropropane/(mixture of 1,3-dichloro-1,1,2,2,3-pentafluoropropane (225ca/cb) |
| 1,1-dichloro-1,2,2,3,3,3-pentafluoropropane/(mixture of 1,3-dichloro-1,1,2,2,3-pentafluoropropane (25eb/cb) |

EXAMPLES 69–79

The azeotropic properties of the dichloropentafluoropropane components listed in Table III with commercial isohexane grade 2 are studied by repeating the experiment outlined in Examples 3–12 above. In each case a minimum in the boiling point versus composition curve occurs indicating that a constant boiling composition forms between the dichloropentafluoropropane component and commercial isohexane grade 2.

EXAMPLES 80–90

The azeotropic properties of the dichloropentafluoropropane components listed in Table III with 2,2-dimethylbutane are studied by repeating the experiment outlined in Examples 3–12 above. In each case a minimum in the boiling point versus composition curve occurs indicating that a constant boiling composition forms between the dichloropentafluoropropane component and 2,2-dimethylbutane.

EXAMPLES 91–101

The azeotropic properties of the dichloropentafluoropropane components listed in Table III with 2,3-dimethylbutane are studied by repeating the experiment outlined in Examples 3–12 above. In each case a minimum in the boiling point versus composition curve occurs indicating that a constant boiling composition forms between the dichloropentafluoropropane component and 2,3-dimethylbutane.

What is claimed is:

1. Azeotrope-like compositions consisting essentially of from about 68 to about 85 weight percent 1,3-dichloro-1,1,2,2,3-pentafluoropropane and from about 15 to about 32 weight percent 2-methylpentane which boil at about 52.7° at 750.4 mm Hg wherein the components of the azeotrope-like composition consist of 1,3-dichloro-1,1,2,2,3-pentafluoropropane and 2-methylpentane.

2. The azeotrope-like compositions of claim 1 wherein said compositions boils at 52.7° C.±about 0.4° C. at 750.4 mm Hg.

3. The azeotrope-like compositions of claim 1 wherein said compositions boil at 52.7° C.±about 0.3° C. at 750.4 mm Hg.

4. The azeotrope-like compositions of claim 1 wherein said compositions boil at 52.7° C.±about 0.2° C. at 750.4 mm Hg.

5. The azeotrope-like compositions of claim 1 wherein said composition consist essentially of from about 71 to about 83 weight percent 1,3-dichloro-1,1,2,2,3-pentafluoropropane and from about 17 to about weight percent 2-methylpentane.

6. The azeotrope-like compositions of claim 1 wherein an effective amount of an inhibitor is present in said compositions to accomplish at least one of the following: inhibit decomposition of the compositions; react with undesirable decomposition products of the compositions; and prevent corrosion of metal surfaces.

7. The azeotrope-like compositions of claim 6 wherein said inhibitor is selected from the group consisting of epoxy compounds, nitroalkanes, acetals, ketals, ketones,-alcohols, esters, and amines.

8. A method of cleaning a solid surface comprising treating said surface with an azeotrope-like composition of claim 1.

* * * * *